United States Patent [19]

Dickinson

[11] Patent Number: 4,974,746

[45] Date of Patent: Dec. 4, 1990

[54] WASTE SEPARATION CONTAINER

[76] Inventor: Addison M. Dickinson, 22 W. Shields St., Newark, Ohio 43055

[21] Appl. No.: 515,073

[22] Filed: Apr. 26, 1990

Related U.S. Application Data

[63] Continuation-in-part of Ser. No. 324,578, Mar. 16, 1989, abandoned.

[51] Int. Cl.[5] ..... B65D 25/16; B65D 25/06

[52] U.S. Cl. ..... 220/404; 220/23.4; 220/23.83; 220/533; 220/500; 220/909; 248/95; 248/101

[58] Field of Search ..... 220/1 T, 20, 22, 22.3, 220/22.1, 23.4, 23.83, 403, 404; 248/95, 97, 99, 100, 101

[56] References Cited

U.S. PATENT DOCUMENTS

| | | | |
|---|---|---|---|
| 1,923,816 | 8/1933 | Firl . | |
| 2,113,153 | 4/1938 | Jonassen . | |
| 2,308,398 | 1/1943 | Stevens | 220/404 |
| 2,319,381 | 5/1943 | Callan | 220/404 |
| 2,625,973 | 8/1951 | Weldon . | |
| 2,736,454 | 2/1956 | McConnell . | |
| 3,142,847 | 8/1964 | Kurrels | 220/404 |
| 3,904,218 | 9/1975 | Kostic . | |
| 3,977,450 | 8/1976 | Schampier . | |
| 3,995,924 | 12/1976 | Jones . | |
| 4,585,283 | 4/1986 | Redmon . | |
| 4,610,039 | 9/1986 | Stern . | |
| 4,775,123 | 10/1988 | Borland . | |
| 4,801,034 | 1/1989 | Sandomeno . | |
| 4,834,260 | 5/1989 | Auten | 220/404 |
| 4,874,111 | 10/1989 | Heller | 220/404 |
| 4,905,853 | 3/1990 | Strawter | 220/404 |

FOREIGN PATENT DOCUMENTS

| | | |
|---|---|---|
| 1104627 | 7/1981 | Canada . |
| 233366A | 12/1986 | European Pat. Off. . |
| 3446100 | 6/1986 | Fed. Rep. of Germany . |
| 3600603 | 9/1986 | Fed. Rep. of Germany . |
| 2302255 | 9/1976 | France . |
| 767364 | 1/1957 | United Kingdom . |

*Primary Examiner*—George E. Lowrance

*Attorney, Agent, or Firm*—Polster, Polster and Lucchesi

[57] ABSTRACT

A waste separation container for selectively separating and storing waste material includes a receptacle with an upper edge with slits in its opening upwardly to receive and hold a plurality of thin plastic bags in an open position. The slits are preferably defined by flexible lobes, contiguous one another and extending along the upper edge of the receptacle. Preferably, a closure for the receptacle is provided, that has specifically designated through apertures that allow for discernable placement of recyclable material in a correspondingly appropriate compartment or bag. The provision of strips of flexible material with lobes defining between them bag-retaining slits, either to be mounted on existing containers, on partitions for existing containers or holders to be placed in existing containers permits retrofitting of existing waste receptacles to accomplish the object of making easy the segregation of waste as it is generated.

11 Claims, 19 Drawing Sheets

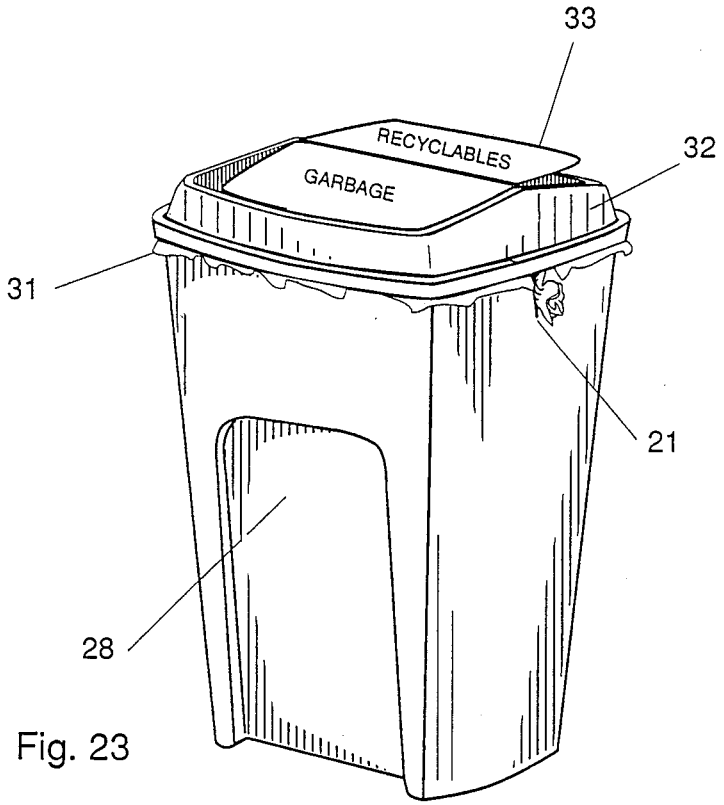
Fig. 23
Fig. 24
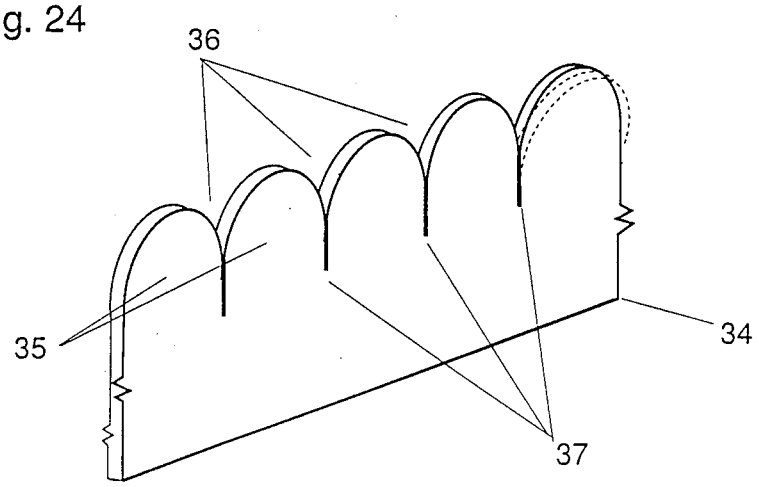

WASTE SEPARATION CONTAINERCROSS-REFERENCE TO RELATED APPLICATION

This is a continuation-in-part of my co-pending application Ser. No. 324,578, filed Mar. 16, 1989, now abandoned.

BACKGROUND OF THE INVENTION

Considering our rapidly deteriorating ecological conditions due to waste incineration, underground water contamination from garbage landfills and ocean dumping, there is obviously a serious waste management problem. A large portion of our garbage (trash) can be reclaimed, recycled and resold. Traditionally waste containers have not been designed to facilitate the source separation required for highly effective recycling programs to be successful. Nor have they incorporated the convenience required to encourage wide spread, willing participation.

Current waste disposal containers discourage and hamper recycling efforts by their inherent design where only a co-mingling of recoverable waste is provided for. They fail to provide the plurality of compartments and the ability to hold and support multiple liner bags which would greatly enhance the effectiveness of such endeavors.

In essence, this type of waste container is unsatisfactory because it makes it necessary to provide separate containers that require additional space for people who separate their recyclable waste. It is easy to understand why only a very small portion of our population takes part in any recycling effort. Waste containers have been suggested in which a plurality of self-supporting subcontainers are held in a large, open-topped box type of container or a frame, but these tend to be expensive and to be difficult to handle. Other containers have been proposed in which single plastic bags are supported, or, in laundry hampers, in which bags made specially to be accommodated by the hampers are arranged to receive different kinds of laundry, or in which partitions are arranged, but not to support plastic bags. All of these have had drawbacks that have evidently militated against their commercial acceptance when it comes to the segregation of recyclable trash.

Therefore, not only the ecologically concerned people who do separate their recyclable material would find it desirable to have a multiple plastic bag holding container, but people who have not heretofore done so would be likely to start if an attractive, easy to use multiple bag holding container were provided, especially if the lid of such a container has specifically designated through apertures that allow for discernable placement of specific materials in a correspondingly appropriate compartment or bag.

One of the objects of this invention is to provide a device to facilitate the sorting of trash and garbage, that is adapted to be used inside the home, office, factory, hospital, or commercial establishment, is economical to manufacture, easy to use, rugged, safe and durable.

Another object is to provide a multiple bag holding container that may readily be adapted to accommodate not only different shapes and sizes of liner bags, but also the desire of the user to separate waste materials either totally or partially.

Another object is to provide means in which existing waste receptacles may be retrofitted to facilitate the support and holding of multiple liner bags.

Other objects will become apparent to those skilled in the art in the light of the following description and accompanying drawings.

SUMMARY OF THE INVENTION

In accordance with this invention, generally stated, a trash receptacle is provided in which a plurality of thin-walled, flexible bags are supported to receive trash or garbage. In one embodiment, a container has an upper lip defining an open mouth and a detachable and re-attachable cover, the cover comprising a frame with an outer flange shaped complementarily to the perimeter of the upper lip and dimensioned frictionally to engage the upper lip. The frame defines an opening, and a lid, pivoted to the frame at both ends of a center line of the lid, within the opening is adapted to be biased to a mouth closing position and to be swung away from the mouth closing position to permit entry of material to one side or the other side of the mouth. Slots are provided in the container, extending through the lip and opening upwardly therethrough, the slots being substantially aligned with the lid center line and each of the slots being of a width and depth to accommodate part of upper margins of two thin plastic bags. Another part of the margins of the two bags extends between the slots, the margins of the two bags being parallel to one another and substantially aligned with the center line of the lid. Yet another part of each margin is draped over the lip and held between the lip and the frame flange, whereby when the lid is swung in mouth-opening direction, material passed through the opening on one side of the center line passes into one bag, and material passed through the opening on the other side, passes into the other bag.

In another embodiment, one or more bag retainers is provided, each in the form of a multiplicity of contiguous lobes or ears, defining between them a relatively wide mouth and a narrow slit adapted to receive and hold securely a margin of a thin plastic bag. The retainer or retainers can be integral with the upper edge of a container, or a part or parts of dividers or other supports. They can be provided in strip form, made of heavy, but flexible, plastic. to be mounted on or secured to a support, generally the upper margin of a container. The ears are flexible, and can be moved out of the plane of contiguous ears to facilitate introduction of the bag margin to the slot or removal of the bag margin from the slot defined by and between the contiguous ears.

In any embodiment of container in which a cover or lid is supplied, it is contemplated that indicia, which can be in the form of words or illustrations, be applied to designate the kinds of waste to be deposited in a particular bag, or that openings of different shapes or sizes or both be provided to make reasonably certain that the appropriate waste be deposited in the bags beneath the cover, or, preferably, both indicia and sized and shaped apertures be supplied, where feasible.

LIST OF REFERENCE NUMERALS

1. Container
2. Side wall
3. End wall
4. Bottom wall
5. Grooves
6. Partition

7. Partition
8. Spaced openings
9. Alternate partition
10. Alternate partition mounting means
11. Bags
12. Retro fit cross member
13. Retro fit cross member mounting means
14. Existing container
15. Alternate lid
16. Lid
17. Retro fit lid
18. Alternate retro fit lid
19. Alternate retro fit lid
20. Lids through apertures
21. Liner bag support structure
22. Wide open mouth
23. Narrow slit
24. Wall material
25. Bags handle portion
26. Corrugated slit
27. Slit with one serration
28. Dual liner bag receptacle
29. Opposing container walls
30. Bags
31. Bag upper end portion
32. Lid
33. Swinging door for lid
34. Multiple liner bag support structure flattened plastic strip form.
35. Contiguous teeth or lobes
36. Plurality of wide open mouths
37. Plurality of narrow slits
38. Multiple liner bag waste separation container
39. Rivets
40. Closure
41. Apertures 41A Garbage, 41B glass, 41C Plastic, 41D newspaper, 41E fine paper, 41F cardboard, 41G aluminum cans, 41H metal, 41I hazardous waste
42. Individually removable receptacle
43. Large partitioned multiple liner bag waste separation container
44. Partition member
45. Lid for large partitioned multiple liner bag waste separation container
46. Existing waste receptacle—round
47. Existing fit assembly lid—round
48. Retro fit assembly receptacles—quarter round
49. Magnet
50. Retro fit assembly receptacles—rectangular
51. Existing waste receptacle—rectangular
53. Retro fit assembly lid—rectangular with swinging door
54. Retro fit assembly lid—square
55. Existing waste receptacle—square
56. Retro fit assembly receptacles—square

BRIEF DESCRIPTION OF THE DRAWINGS

In the drawings.

FIG. 23 is a perspective view of the waste receptacle of FIGS. 21 and 22 including a swinging door lid;

FIG. 24 is a fragmentary perspective view of a multiple liner bag support structure in plastic strip form;

DESCRIPTION OF THE PREFERRED EMBODIMENTS

Figure 1:
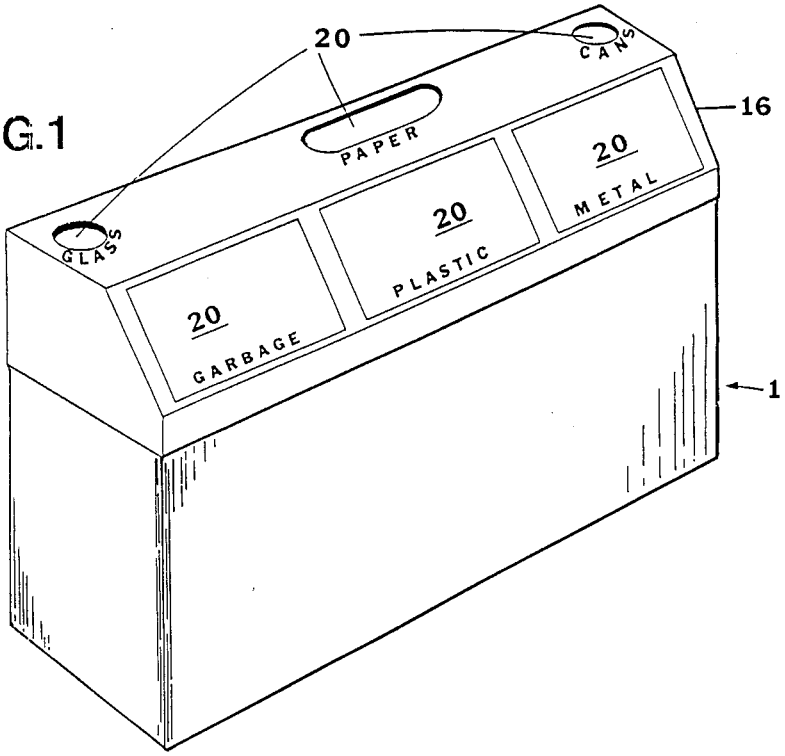
FIG. 1 is a perspective view of a waste separation container of this invention showing a lid with designated through apertures.

Referring to the drawings for illustrative embodiments of this invention, FIG. 1 shows an overall view of the waste separation container of the invention. The base container 1 is covered by a lid 16 that is but one of many designs that have a utilitarian function of facilitating discernable placement and separation of recyclable material and garbage by the use of designated through apertures 20, said through apertures generally being of a size and shape so as to encourage source separation of recyclable waste.

Figure 2:
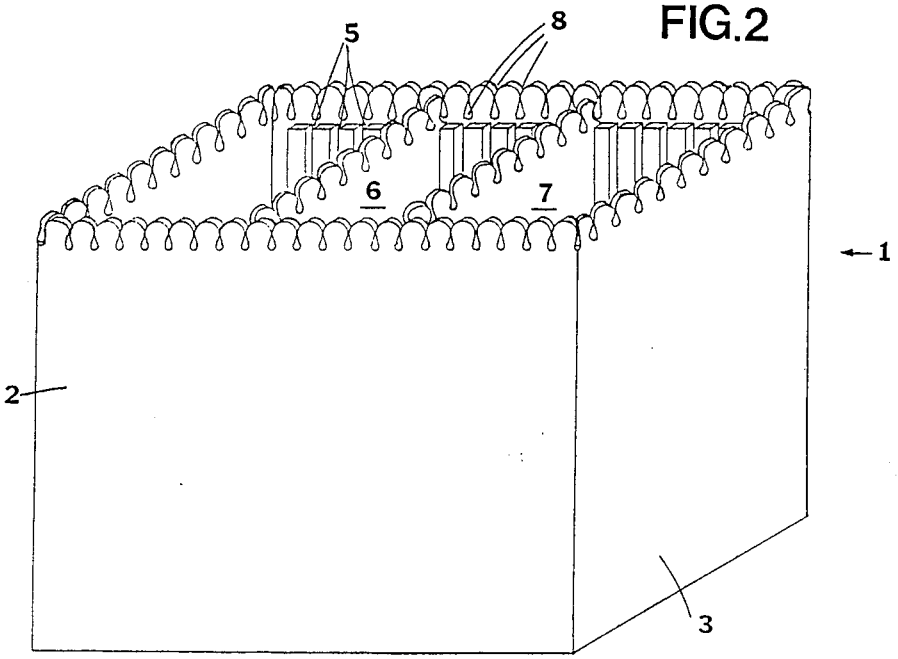
FIG. 2 is a perspective view of a container with two partition members therein.
Figure 3:
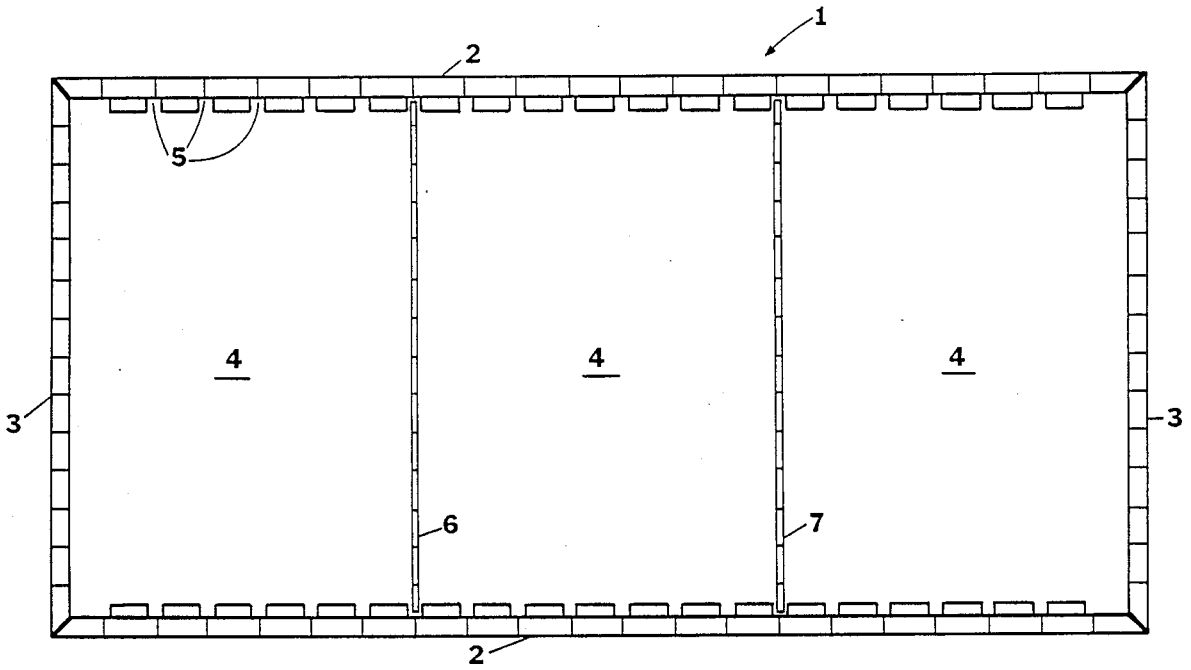
FIG. 3 is a top plan view of the base container of FIG. 2.
Figure 4:
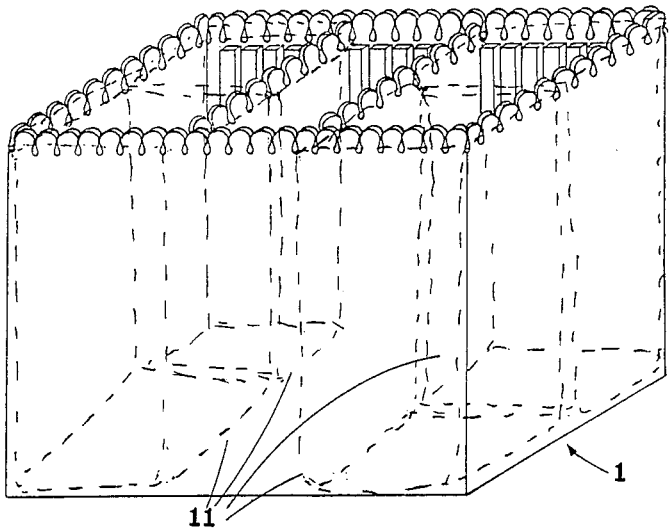
FIG. 4 is a perspective view of base container showing one possible arrangement of four liner bags.

FIGS. 2, 3 and 4 show a one piece molded synthetic resin open topped container 1 having opposed generally parallel side walls 2, opposed generally parallel end walls 3, and a generally rectangular bottom wall 4. However, it will be understood that the invention is applicable to receptacles of various shapes and sizes. Side walls 2 and end walls 3 are molded to form at the uppermost portion a plurality of contiguous teeth which in this embodiment take the form of lobes or ears 28 that define between them spaced openings 8, which provide the means for removably holding, in an open position, a selective number of bags in a selectively variable arrangement. Preferably, side walls 2 are molded to form on the inner surface a plurality of bosses 29, spaced form one another to define between them vertically spaced channels 5, like channels being parallel and in transverse alignment with each other for substantially the full height of said side walls for receiving therein partitions for partitioning the interior of container 1. Partition members 6 and 7 are separate from container 1 and are molded from a synthetic resin, which can be the same as the resin from which the container is molded. They are of a size and rectangular shape to allow secure positioning within a selected pair of said side wall channels 15 and molded to form at their uppermost portion a plurality of spaced openings 8 substantially identical to the plurality of spaced openings of end walls 3, so that when partition members are placed in container 1, spaced openings are opposed and in vertical alignment with said end walls spaced openings. They thus can be used to provide not only means for removably mounting a larger number of bags in a selectively more variable combination of arrangements, but by selective positioning of partition members also provide the ability to accommodate different sizes and shapes of bags.

FIG. 4 shows one of the many possible combinations in which four bags 11 could be arranged.

Figure 5:
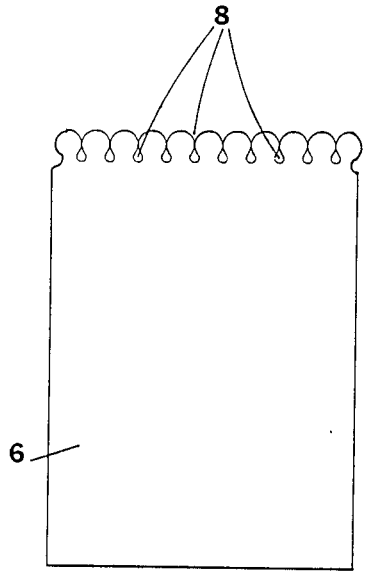
FIG. 5 is a view in side elevation of a rectangular partition member.
Figure 6:
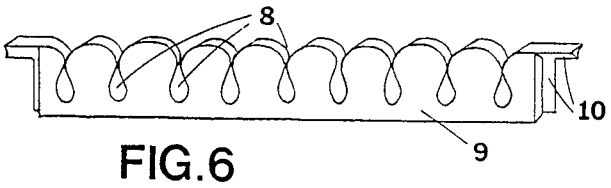
FIG. 6 is a perspective view of an elongated holding and support member.

FIG. 5 shows partition member 6 removed from container 1. As can be seen it is generally rectangular and extends to the top of container 1 and is of a size and shape so as to divide the full space of container 1. However, in FIGS. 6 and 7 a one piece molded synthetic resin elongated support member 9 having a plurality of spaced openings 8, that is translated horizontally relative to the base container, could substitute and facilitate the same functions as partitions 6 and 7.

Figure 7:
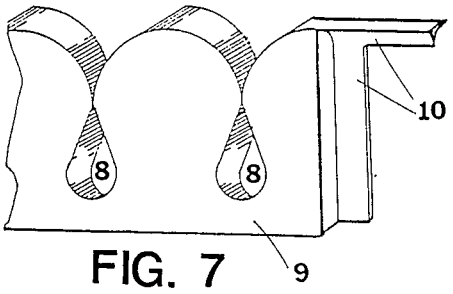
FIG. 7 is an enlarged perspective view, partly broken away, of an elongated holding and support member, showing mounting means.

FIG. 7 shows mounting mans 10 for such a support member, where material at opposite ends of said support member is formed so as to allow selective positioning in a secure manner into a selected pair of spaced openings 8.

Figure 8:
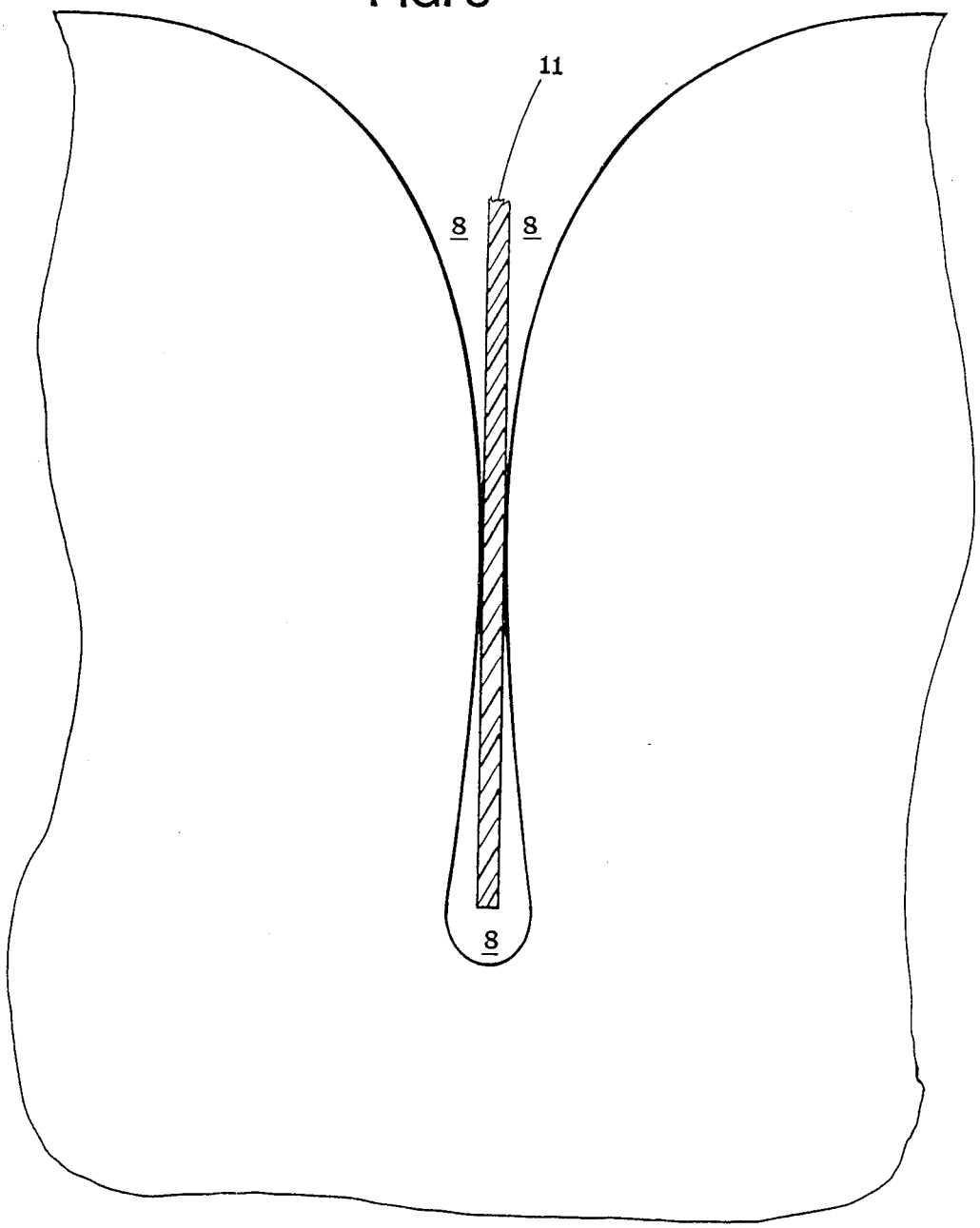
FIG. 8 is an enlarged fragmentary side view of two lobes or ears defining an opening, showing, in cross section, a marginal portion of a liner bag being removably held.

FIG. 8 shows the exploded view of two lobes defining between them a single spaced opening 8 that provided the means for removably holdings bags 11 and/or partition support members 9. The lobes individually are of a general shape to define an opening that opens upwardly as a wide mouth, tapers downwardly to a point of near contact whereby adequate oppositional force is maintained to removably hold a portion of the upper marginal edge of a bag, and then enlarges to provide a generally triangular shaped space to accommodate excess of said portion of said upper marginal edge of said bag.

Retro fittings existing waste receptacle of any size and shape with multiple bag holding means and lids with designated through apertures are best shown in FIGS. 9, 10, 11, 12, 13 and 14.

Figure 9:
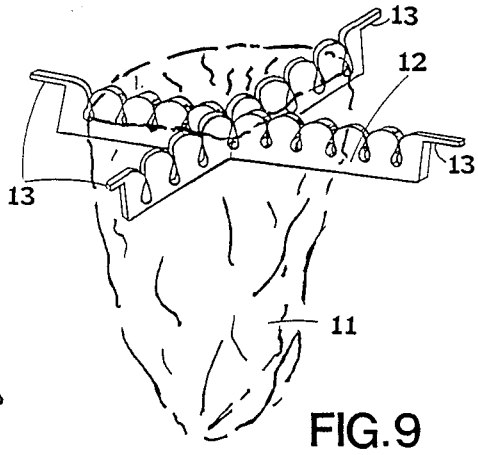
FIG. 9 is a view of a multiple bag holding cross member for retro fitting of existing waste receptacles, showing only one liner bag removably held.

FIG. 9 shows a molded synthetic resin cross member 12 that is formed with a plurality of spaced openings 8 at the uppermost portion substantially identical to spaced openings that have heretofore been described in detail.

Figure 10:
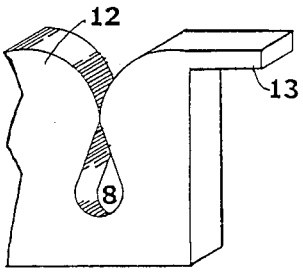
FIG. 10 is an enlarged, fragmentary view in perspective of the cross member of FIG. 9, showing the detail of mounting means for the retro fitting cross member of FIG. 9.
Figure 11:
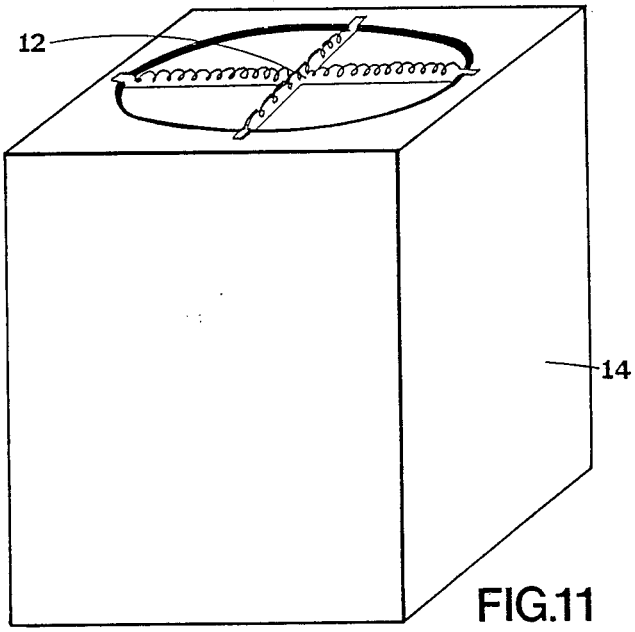
FIG. 11 is a perspective view of a retro fitting cross member of FIG. 9 mounted in an existing waste receptacle.

One bag 11 is shown removably held to cross member 12. Mounting means integrally molded with cross member 12 is best shown in FIG. 10 where a simple flange 13 at the end of each section of cross member 12 is joined to the top of an existing receptacle 14 as shown in FIG. 11. However, it should be noted that many variations are possible for retro fitting existing waste receptacle with multiple bag holding means and should not be limited to the above described details.

Figure 13:
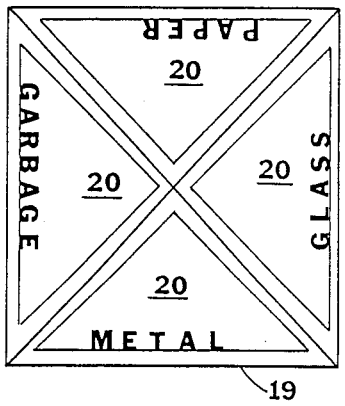
FIG. 13 is a top view of an alternate retro fitting lid with designated through apertures.
Figure 12:
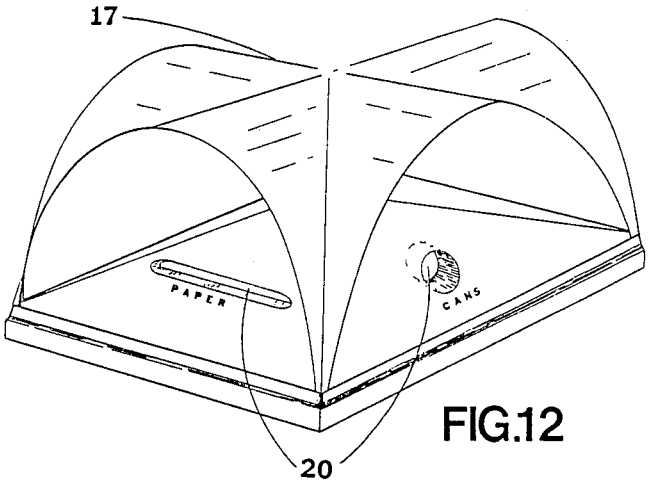
FIG. 12 is a view of a lid with designated through apertures that is used in retro fitting existing receptacles also.
Figure 14:
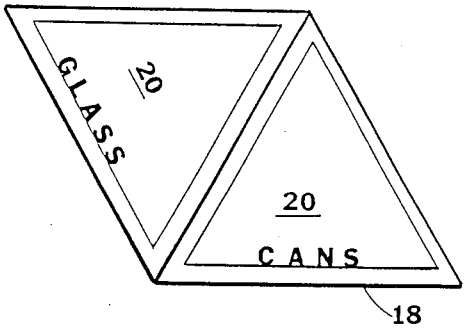
FIG. 14 is a view of another retro fitting lid with alternate designated through apertures.

FIGS. 12, 13 and 14 are examples of lids for completion of retro fitting existing waste receptacles in which lids 17, 18 and 19 have designated through apertures 20 and are joined to multiple bag, retro fitted waste receptacles in a conventional manor so as to cooperate in facilitating the separation of recyclable material, said retro fitting lids can be made of any suitable material.

Figure 15:
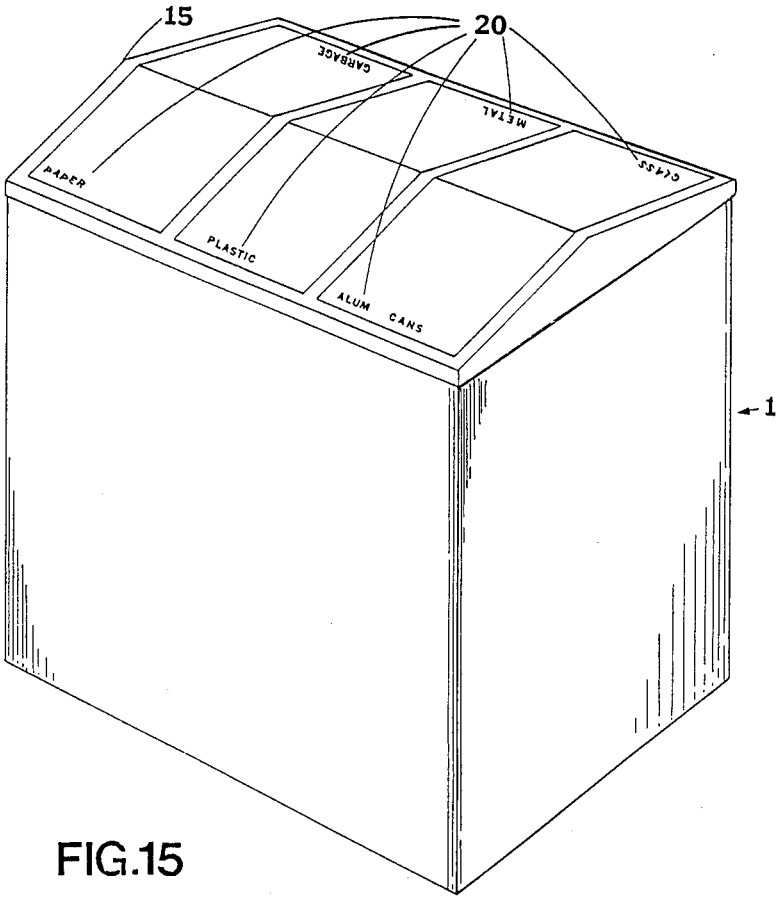
FIG. 15 is a perspective view of the waste separation container of FIG. 2 with an alternate lid with designated through apertures.

FIG. 15 shows an alternate lid with designated through apertures 20 that allow for discernable placement and separation of recycling material in a correspondingly appropriate bag or compartment, in relation with the base container of FIGS. 1, 2, 3 and 4.

Figure 16:
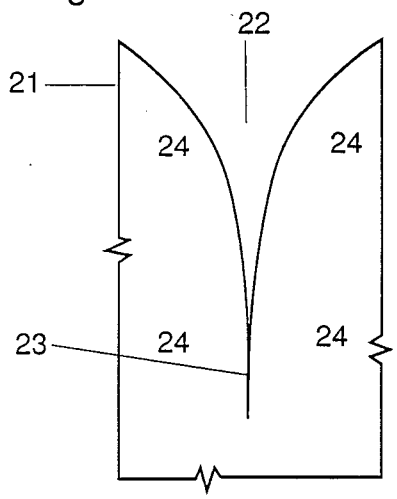
FIG. 16 is a fragmentary side view of wall material forming a slit opening.

Referring to FIG. 16, there is illustrated a liner bag support structure 21 in the form of a flexible plastic body 24, which can be in strip form or constitute an upper edge part of a container body, with an opening having an upper wide open mouth 22 descending to a narrow slit 23. Because the body 24 is made of flexible material, it serves to admit the entry of an upper margin or handle of a thin plastic bag and to grasp or clamp it firmly in place. This structure may be of any suitable size, shape, construction or material or any combination thereof, but preferably the structure is comprised of a resilient, flexible, durable plastic and the method of manufacture preferably involves a cutting process rather than strictly a molding one so that the wall material 24 forming the opening and particularly slit 23 provides adequate oppositional force securely to hold an upper portion of one or more bags, but to permit the held potion easily to be removed by pulling upwardly, particularly if one of the leaves or lobes the edge of which defines one side of the opening is moved out of the plane of the body.

Figure 17:
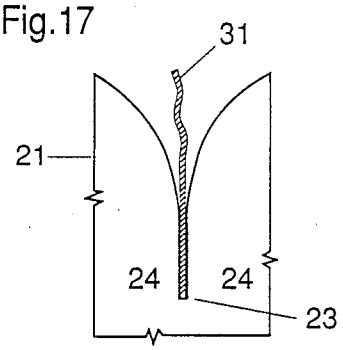
FIG. 17 is a fragmentary side VieW of Wall material forming a slit with a cross section of a bag's upper end portion inserted thereinto.

FIG. 17 shows somewhat schematically a cross section of a bag's upper end portion 31 inserted and retained in support structure 21.

Figure 18:
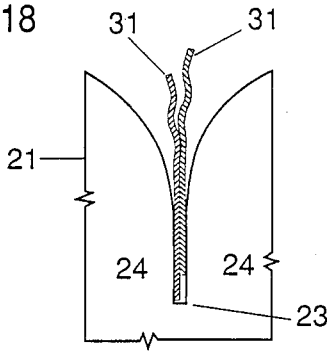
FIG. 18 is a fragmentary side view of wall material forming a slit with a cross section of two bags upper portion inserted thereinto.

FIG. 18 shows somewhat schematically the bag upper end portion 31 of two bags inserted into the same support structure.

Figure 19:
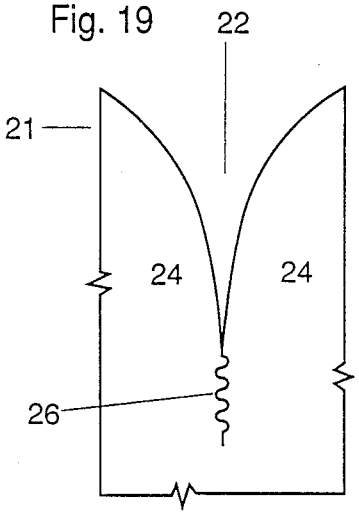
FIG. 19 is a fragmentary side view of wall material forming an opening with a corrugated slit.
Figure 20:
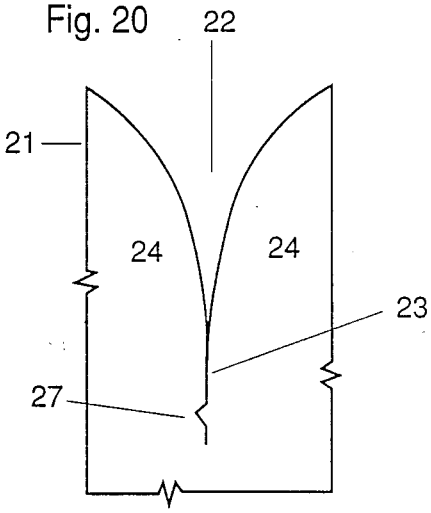
FIG. 20 is a fragmentary side view of a wall material forming an opening with a slit with a serrated portion.

FIG. 19 shows a structure similar to that of FIG. 16 except that there is a corrugated slit 26 to provide additional grasping force for bags with very thin walls. FIG. 20 is also similar except slit 23 has one serration 27. Accordingly, the same method of manufacture, materials and function described for the structures in FIGS. 16, 17 and 18 also apply to the structures in FIGS. 19 and 20.

All of the structures and combinations described in FIGS. 16, 17, 18, 19 and 20 may optionally include a second opening under the slits 23, 26 or 27 to receive the excess bag upper marginal portions and to terminate the length of the slit as is shown in FIGS. 6, 7, 8 and 10.

Figure 21:
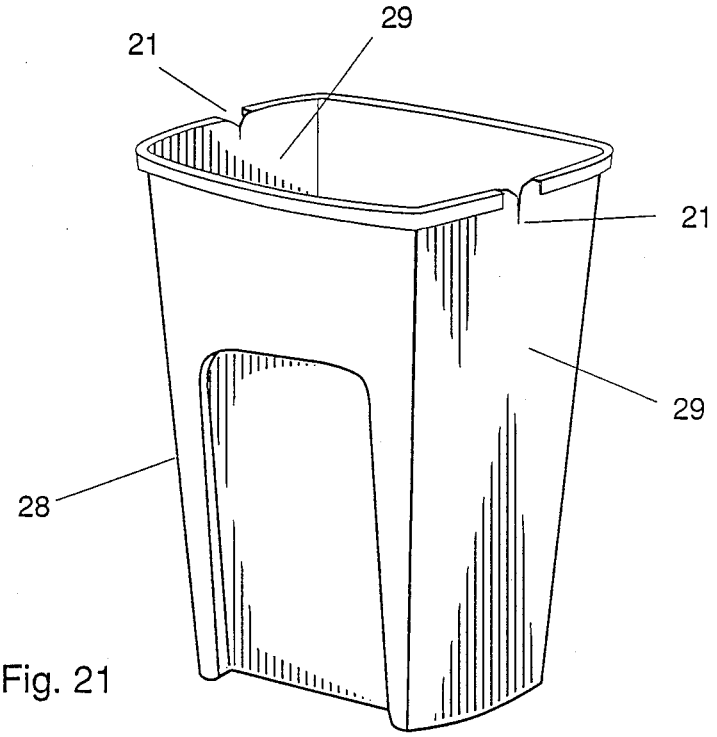
FIG. 21 is a perspective view of a non-partitioned plastic waste container with two openings at the uppermost rim portion thereof.
Figure 22:
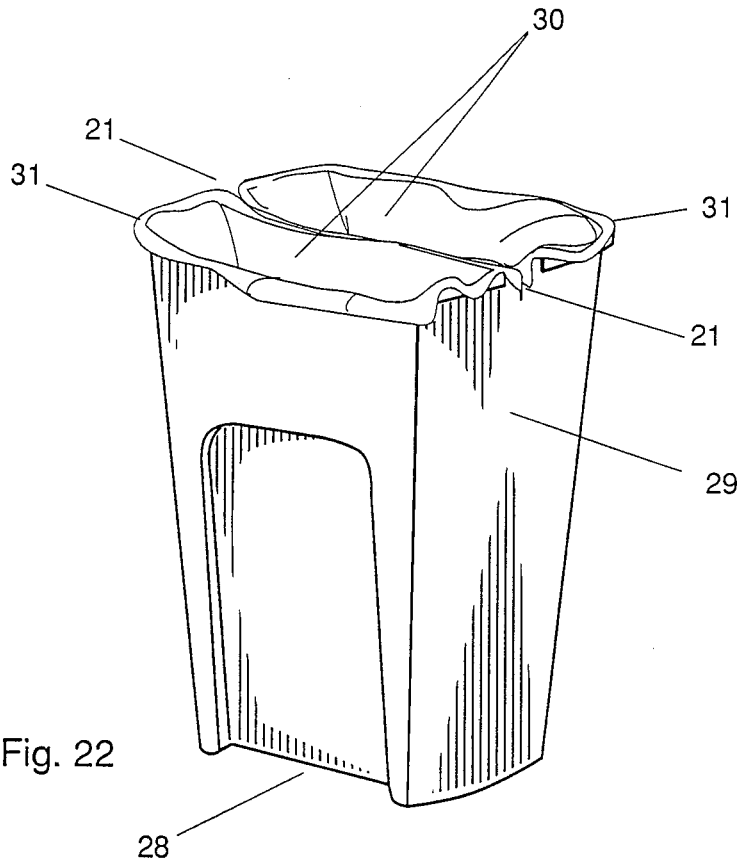
FIG. 22 is a perspective view of the waste receptacle of FIG. 21 holding two liner bags.

FIG. 21 shows a dual liner bag plastic waste receptacle 28 in a condition to conveniently receive and support in an upright open condition two liner bags placed in a side by side arrangement, wherein two liner bag support structures 21 are integrally molded and/or cut or formed at the uppermost rim portion of the receptacle 28. The liner bag support structures 21 are positioned and generally centered on opposing walls 29 and aligned with each other. FIG. 22 shows two bags 30, side by side, securely retained within receptacle 28 by liner bag support structure 21 wherein individually, upper edge portions 31 of the bags 20 are secured by first folding the bag upper edge portion 31 outwardly over the top edges of the receptacle 28, which are defined by an outwardly downwardly extending channel or lip, and then inserting a part thereof with one's hand into the slit 23 of each of the openings of the support structure 21. Wide open mouth 22 helps guide the bags' upper end portion 31 into slit 23.

FIG. 23 shows a lid 12, with a hinged sWinging door 13, positioned on top of receptacle 28 with that part of the upper end portion 31 of the bags 30 that is lapped over the lip of the container trapped between the lip of the container and an inside surface of an outwardly and then downwardly extending rim of the lid. Swinging door 33 is designated with words or symbols denoting garbage for one side and recyclables for the other side. Swinging door 33 tilts and opens one way to allow entry and access to one bag and tilts the opposite way to allow entry and access to the other bag. One bag is for waste or non-recyclables and the other bag is for co-mingled recyclables.

The dual multiple liner bag waste separation container 28 of FIG. 23 provides a convenient, egronomical, esthetically pleasing structure for collecting and storing co-mingled recyclables as well as non-recyclables, that can be used in the home or any place else that is desired, that covers the waste and recyclables, and that also helps prevents the odor from escaping.

The multiple liner bag support structure 34 in flattened plastic strip form is shown best in FIG. 24 and is comprised of a plurality of spaced apart openings with a plurality of upper wide open mouths 36 correspondingly descending to a plurality of narrow slits 37 defined by a series of integral flexible contiguous teeth, ears or lobes 35 and serving to admit the entry of bag upper end portion 31 and/or handle portion 25 and to grasp or clamp it firmly in place.

The multiple liner bag support structure 34 is preferably constructed with a uniform cross section and consists of a resiliently flexible sheet of material which can be repeatedly bent without fracturing and it should be noted that the preferable method of manufacture is to die cut the slits 13 in order to provide lobe 15 with adequate oppositional force to securely removably hold and reliably retain the material of a bag or bags.

The multiple liner bag support structure 34 may be of any size, shape or construction for adequate bag support or placement for instance, to prevent slippage, and assisting secure support they may be serrated, barbed, positioned differently, angled and/or formed differently, for instance, like a hook, have varying wall thickness, etc., and may further be made of any suitable material or combination thereof, although a width of one and one half inches ($1\frac{1}{2}$) for each flexible lobe 35 works quite well.

The flexible multiple liner bag support structure 34 in flattened strip form has many uses wherein individual strips and the strips' openings are positioned in opposing alignment with each other and applied for instance in the construction of new waste receptacles and the retrofitting of existing waste receptacles of any size, shape or construction or may be included in a kitchen cabinet or undercounter assembly, tilt-table, roll-out, stationery, etc. The structure may be used in a stand alone horizontal or vertical frame, adjustable and/or collapsible to be used alone or to be inserted into or upon a drawer, etc. It is generally positioned at the upper portions of such structures and attached in any conventional way, as by gluing or riveting. It may be provided with a channel at its lower edge to receive an upper edge of a container. Whether separately attached or integral with the container, it provides means in which a selectively variable number and arrangement of liner bags may be reliably retained and quickly and conveniently positioned in an open upright condition.

Figure 25:
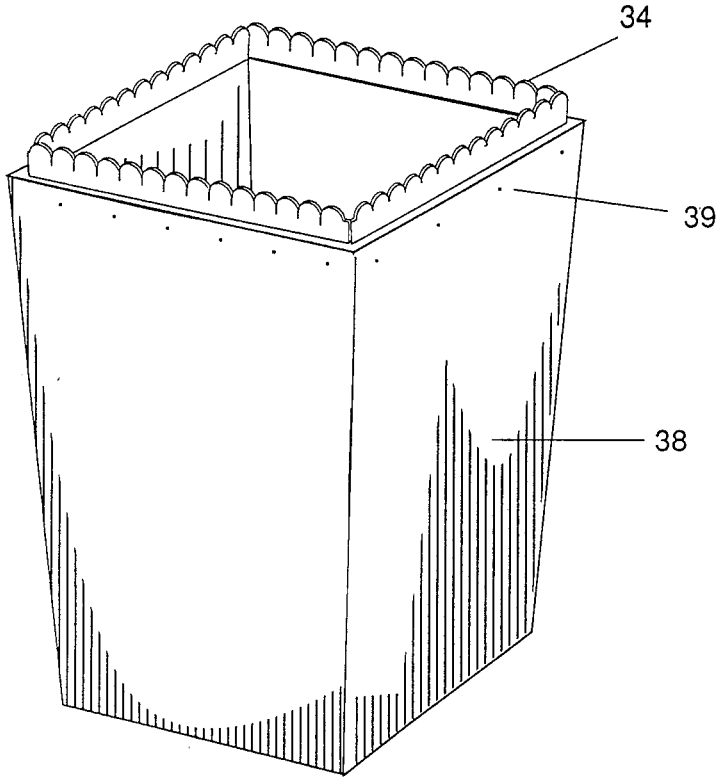
FIG. 25 is a perspective view of a multiple liner bag support structure in plastic strip form attached to the uppermost portion of a waste container.

FIG. 25 shows the improved multiple liner bag support structure 34 attached to the top of receptacle 38 with rivets 39, providing a means in which a plurality of liner bags (ones with handles or drawstrings or without) may be quickly and conveniently positioned and removably held and reliably retained in an open mouth, upright, selectively variable arrangement.

Figure 26:
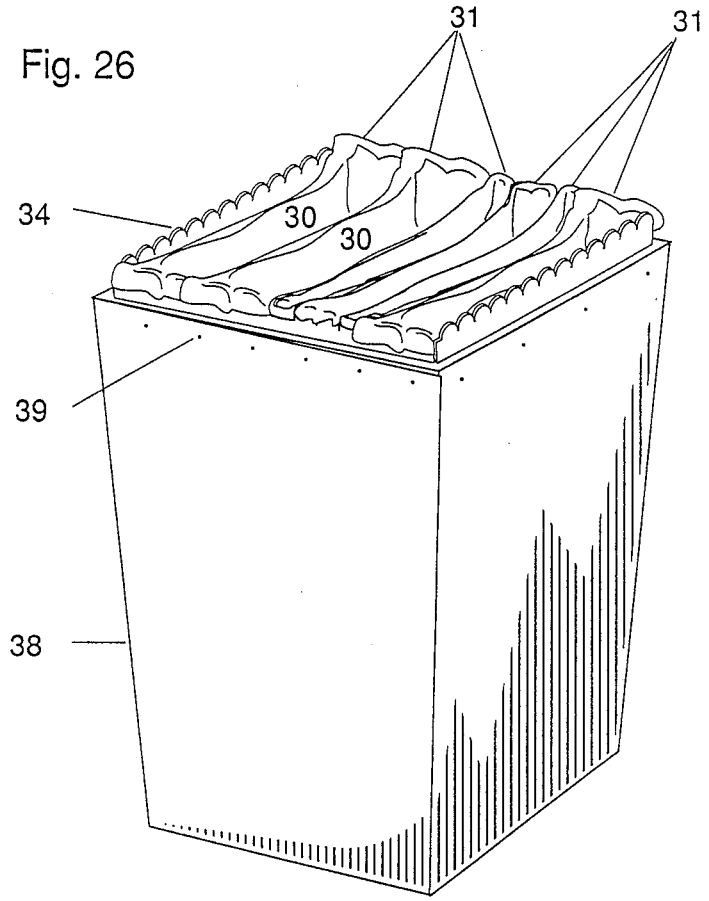
FIG. 26 is a perspective view of the waste receptacle of FIG. 25 holding a plurality of liner bags.

FIG. 26 shows just one possible arrangement of liner bags 10 in receptacle 38. The bags 30 are positioned and secured to the support 34 by first folding a portion of the bag end portion 31 or handle portion 25 outwardly over the top edge of the lobes 35, and then inserting a part thereof with one's hands into a selected slit 37, this particular procedure is generally repeated four times in four places, per bag in order to support the bag in an open mouth condition. This general procedure is repeated for each bag. The bags are positioned according to the user's desire or need, or to align with the apertures in a lid if used. The bags being positioned and retained in a contiguous relation by the support structure in a container for instance, are for receiving material, the particular material designated for a particular bag can be inserted and compacted thereinto, limited only by the capacity of the bag or the space restrictions of adjacent bags and the container itself. Therefore, the bags expand according to the amount of material put into them and the space limitations dictated by adjacent bags and the capacity of the container itself. For instance if one bag has a larger volume of materials than the adjacent bags it simply expands and occupies their space making it materials volume self-adjusting.

When it is desired to remove a bag having been attached to support structure 34, one of the two lobes 35 grasping bag material is pushed one way or the other to assist in releasing the bag.

Figure 27:
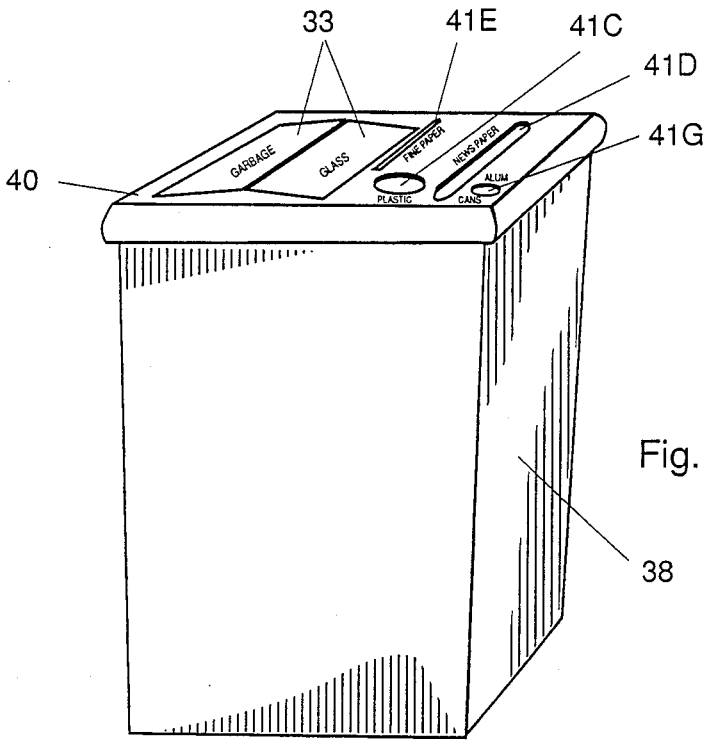
FIG. 27 is a perspective view of the waste receptacle FIG. 26 with a closure having designated apertures of a size and shape to encourage proper placement.

FIG. 27 shows a closure 40 on top of receptacle 38 with designated apertures 41A, 41B, 41C, 41D, 41E and 41G, aligned with open mouths of six bags, not here shown, but which are mounted in much the same way as the bags 30 shown in FIG. 26.

Preferably a lid is used which has designated apertures aligned with the open mouths of a plurality of bags or receptacles and the apertures are of size and shape to encourage proper placement. What is meant by the appropriate size and shape is that generally the apertures' size would only be slightly larger than the specific size of items to be inserted thereinto, and of a shape that generally may correspond to the shape of the material that is to be deposited thereinto. For example, preferably the size and shape of the aperture for newspaper would be an oblong slot approximately 1 inch to 3 inches wide and 8 inches to 14 inches long as illustrated in FIG. 27 at 41D.

The size and shape of the aperture for aluminum cans 41G would generally be approximately a 3 inch circle, if the cans were not crushed, and could be further shaped also for accommodating crushed cans. The aperture for plastic 2 liter containers 41C could be an approximately 4½ inch circle or a slot-like aperture if the container is crushed. The list can go on and on for each of the many sizes and shapes of individual materials. Thus it can be seen that there are many variable combinations of these apertures that constitute a distinctly different configuration. These apertures of a distinctly different configuration also provide a more efficient use of space on the lid.

Closure 40 may additionally include a swinging hinged door 33 serving the same purpose as previously described. The lids or closures preferably also include symbols or words that specifically designate what material goes into the appropriate aperture and corresponding bag or receptacle.

The lid or closure, although optional, is nevertheless very important in many environments and circumstances.

A closure having specifically designated holes or apertures of a distinctly different configuration from one another and of a size and shape to encourage proper discernable placement of material (and discourage or restrict improper placement of materials) into a correspondingly appropriate bag or receptacle is beneficial for instance when a person in a hurry, who would typically just toss waste or recyclable material into a waste receptacle, is more or less forced to find an appropriate opening for this particular material. The same applies to pranksters wishing to show off and to children who can't yet read. The result is that there is a more uniform segregation of recyclables in the respective bag or receptacle, therefore enhancing many aspects of the recycling efforts.

Closure 40 exemplifies how openings or apertures of a distinctly different configuration from one another encourage the deposit of the same kind of waste material through the same opening and different kinds through different, appropriate openings.

Figure 28:
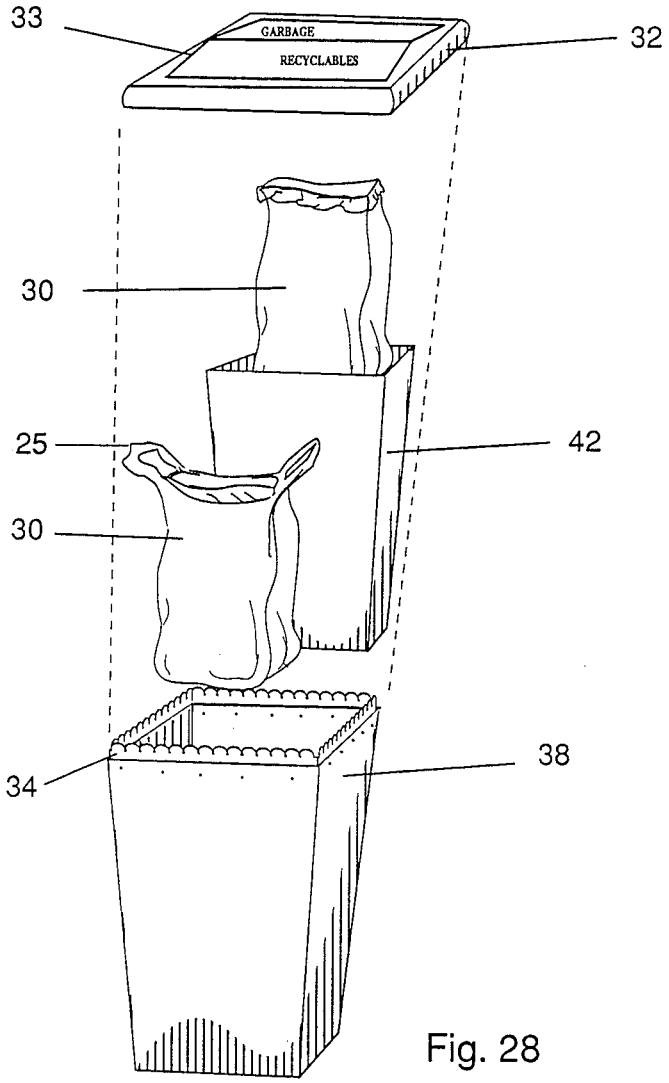
FIG. 28 is an exploded perspective view of a multiple liner bag support structure atop a waste receptacle showing one bag in connection with an individually removable separate receptacle.

The new and useful combination illustrated in FIG. 28 includes an individually removable receptacle 42 that serves the purpose of receiving and collecting commingled recyclables for ease of transportation elsewhere to be separated, for instance the curb. The receptacle 42 is to be placed inside the multiple liner bag waste separation container 38 beside liner bag 30, and may further include another bag 30 that may be inserted into and supported by either receptacle 42 or multiple liner bag waste separation container 38, and is seen helpful in keeping receptacle 42 clean and sanitary. Lid 32 and swing door 33 are positioned above the receptacle denoting proper discernable placement of material and allow access to bags 30 and receptacle 42.

Figure 29:
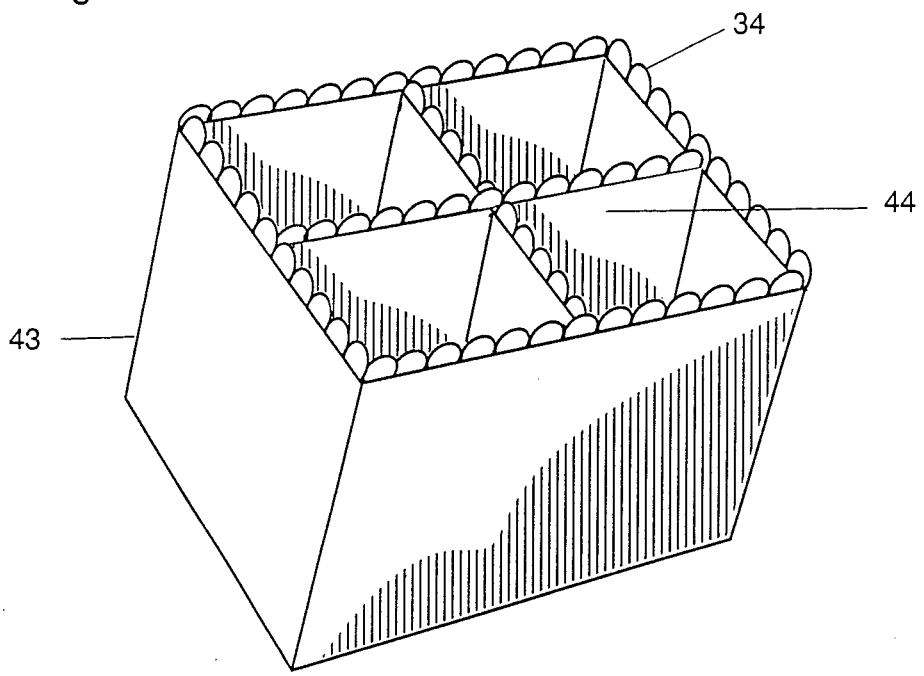
FIG. 29 is a perspective view of a large partitioned container having multiple liner bag support structure.

FIG. 29 shows a larger multiple liner bag waste separation container 43 that is partitioned to allow for a larger number of bags to be removably held in a selectively more variable combination of arrangements, the partition member 44 divides container 43 into four compartments and may be integral or separately attached in any of the many ways possible, to container 43, and generally extends to the top of container 43. The upper portions of container 43 and partition member 44 includes a multiple liner bag support structure 34 either integral with or separately attached and provides means in which a larger number of liner bags 30 may be removably held in an open condition in a selectively variable arrangement that is determined by a corresponding alignment to the apertures in a lid or closure if used. Optionally included also in this particular aspect are three individually removable receptacles 42 best shown in FIG. 30 for the different colors of glass which if separated by color not only benefits the subsequent recycling process but also brings a higher dollar value if resold. The individually removable receptacles 42 are particularly advantageous in the event glass breakage occurs because broken glass can cut through bags.

Figure 30:
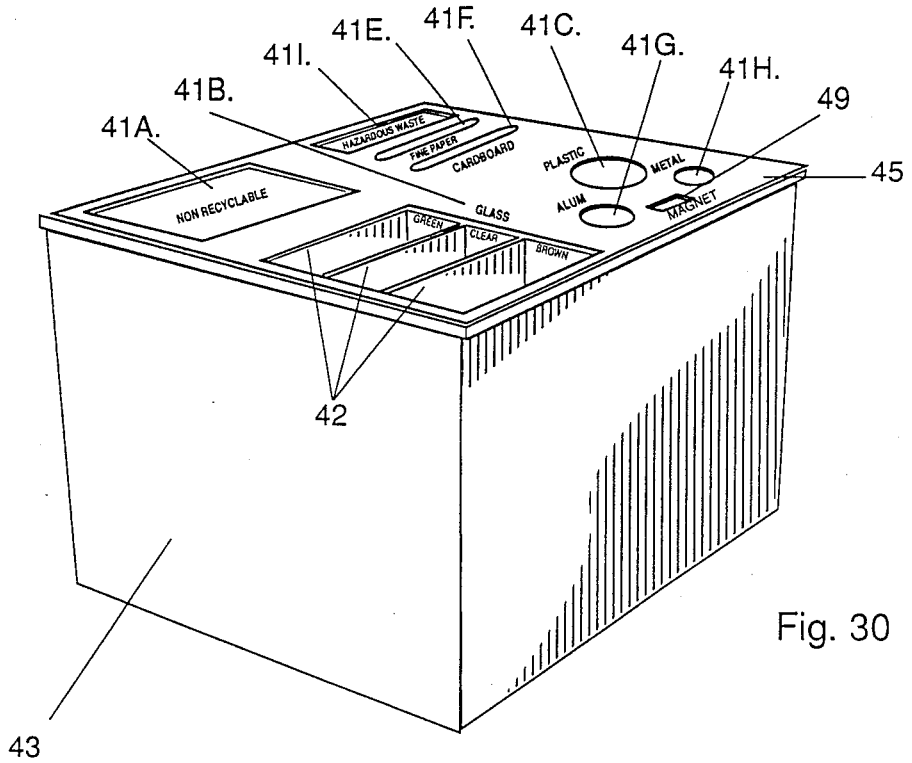
FIG. 30 is a perspective view of the assembly shown in FIG. 29 including a closure or lid in combination with multiple individually removable receptacles.

FIG. 30 shows these individually removable receptacles 42 positioned into a large partitioned multiple liner bag waste separation container 43 and having a lid 45 with designated apertures 41A, 41B, 41C, 41D, 41E, 41F, 41G, 41H, 41I aligned with the open mouths of respective bags, not here shown, and receptacles 42. The partitioned multiple liner bag waste separation container 43, partition 44 and lid 45 may be constructed of any suitable material. Their functions are substantially similar to those of the structures previously described in detail with the exception of magnet 49 which is used to distinguish ferrous and non-ferrous metals so proper placement may be achieved.

Figure 31:
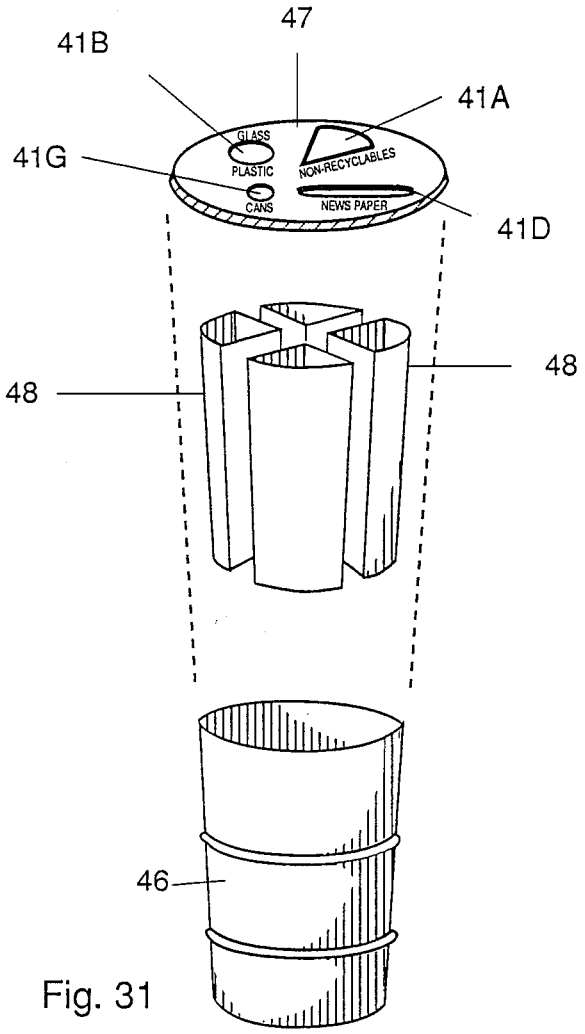
FIG. 31 is an exploded perspective vie of a retro fit assembly for round existing waste receptacles.

This particular assembly of FIGS. 30 and 31 provides for a more complete segregation of recyclables and will be advantageously beneficial in many circumstances and environments such as in schools, business offices, universities, factories, etc. It should be noted that the herein described container and receptacle structures are preferably tapered, nestable and stackable for storage and shipping purposes and may further include wheels for mobility's sake and handles or cutouts may also be included for lifting and such.

Figure 32:
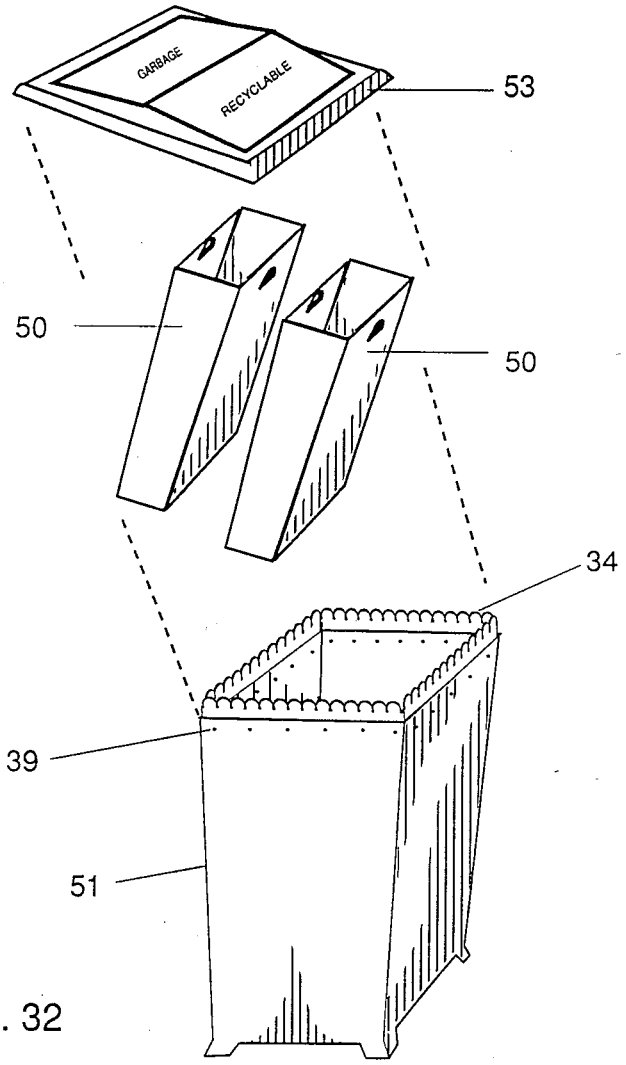
FIG. 32 is an exploded perspective view of a retro fit assembly for rectangular existing waste receptacles.
Figure 33:
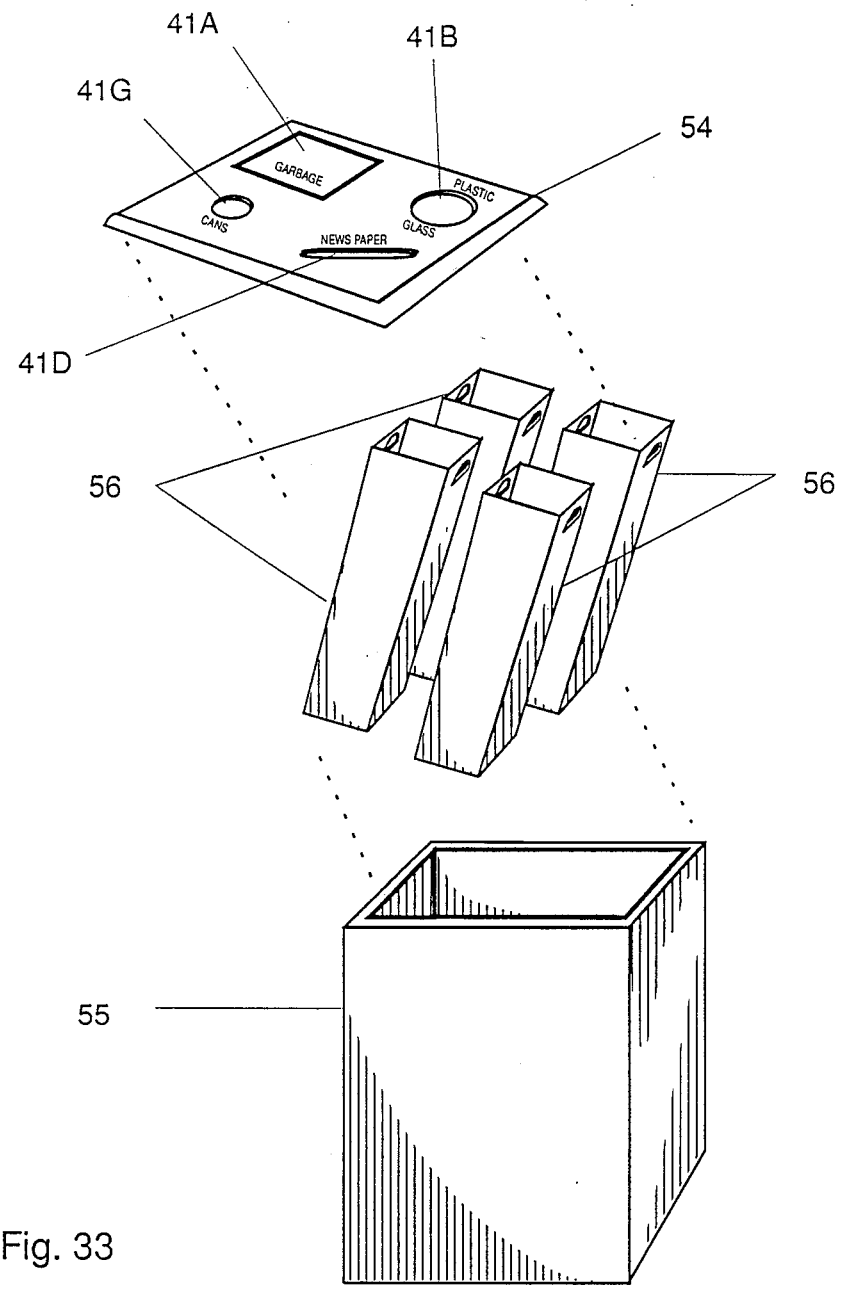
FIG. 33 is an exploded perspective view of a retro fit assembly for square existing waste receptacles.

FIGS. 31, 32 and 33 all illustrate conceptually simple but highly effective retro fit assemblies for existing waste receptacles of a size and shape that is generally determined by the size and shape of the existing receptacles and the desired division of materials. For instance, if a separation of just waste material and commingled recyclables are desired, then the receptacle of FIG. 32 would be best suited, or if a more complete segregation of recyclables is desired the exemplified retro fit assemblies of FIGS. 31 and 33 would be more appropriate. The retro fit assemblies further include closures of the type heretofore described.

FIG. 31 shows a round existing waste receptacle 46 which is typically either fiberglass, metal or plastic that is to be retro fitted with four individually removable receptacles 48 that are quarter round in shape if a top view is taken. Individually removable receptacles 48 are to be inserted into existing waste receptacle 46 and covered by round lid 47. Round lid 47 has specifically designated apertures of a size and shape to encourage proper placement and when attached to existing waste receptacle 46, the apertures should be aligned with the open tops of individually removable receptacles 48. It should be noted that improvements could be made to assure proper alignment.

FIG. 32 shows a slightly rectangular existing waste receptacle 51 which is typically fiberglass, metal, plastic or cement in composition that is to be retro fitted with two rectangular individually removable receptacles 50 and lid with swinging door 53. One side of the swinging door is designated recyclable with words or symbols and opens to allow access to one individually removable receptacle 50 which is for the collection and storage of co-mingled recyclables; the other side of the swinging door is designated for garbage and opens and allows access to the other individually removable receptacle 50. Further included in this particular retro fit assembly is multiple liner bag support structure 34 in plastic strip form separately attached to the top of existing waste receptacle 51 with rivets 39 although many possible attachment means are possible, such as a tongue and groove arrangement for instance. Multiple liner bag support structure 34 is for the support of liner bags if desired which could also be inserted into individually removable receptacles 50 and removably held in an open condition.

FIG. 33 shows a square existing waste receptacle 55 which is also typically fiberglass, metal, plastic or cement in composition that is to be retro fitted with square individually removable receptacles 56 and lid 54, which is to be positioned above individually removable receptacles 56 on top of existing waste receptacle 55 and has apertures 41G, marked cans, 41A, marked non-recyclables, 41D, marked newspaper, 41C, marked plastic and 41B, marked glass, aligned with the open tops of individually removable receptacles 56.

Although the herein described structures can be constructed from any suitable material, it is preferable that whenever possible recycled material be used because it is extremely important for the success of recycling that secondary markets to be expanded.

It is apparent from the foregoing discussion that the present invention provides a more convenient egronomical method for people in all facets of our society to participate in recycling efforts which will greatly increase the quantities of recovered recyclables, therefore conserving our natural resources while reducing pollution from other methods of disposal. Thus the invention has not only optimum simplicity, reliability and economy, etc., but more importantly, contributes positive environmental ramifications for this and future generations.

While my above description contains many specificities, these should not be construed as limitations on the scope of the invention, but rather as an exemplification thereof. Many, many variations are possible. For example, the lid and closures may be equipped with rain shields and various attachments to receptacles means, that may further include various bag support assistance means, material crushing and compacting structures may be added. These are merely illustrative.

Accordingly, the scope of the invention should be determined not by the embodiments illustrated, but by the appended claims and their legal equivalents.

I claim:

1. A waste separation receptacle assembly comprising an open-topped bag holder of a size and shape to receive a plurality of open-topped bags made of thin, strong material, said bag holder having means along upper edges thereof for supporting an upper edge portion of each of a plurality of said open-topped bags to hold said bags open adjacent one another, said means comprising a plurality of spaced lobes defining between them openings opening through their uppermost portion, said openings being of a size to admit material at the upper part of said bags and to hold said material tightly between contiguous of said lobes, for holding a plurality of liner bags in a selectively variable arrangement.

2. The receptacle of claim 1 wherein said lobes define between them an upper, open, wide mouth, a narrow slit, and an enlarged lower opening.

3. The receptacle of claim 1 wherein said lobes are flexible, and capable of being moved manually with respect to one another to facilitate inserting and removing said bag material.

4. The receptacle of claim 1 wherein said lobes are part of an elongated support member mounted on at least two upper margins of said receptacle.

5. The receptacle of claim 1 including a closure extending over and above said holder, said closure having openings aligned with the open mouths of individual bags held in said holder, and indicia adjacent said openings indicating the type of waste to be deposited through each opening.

6. The receptacle of claim 1 including a cover extending over and above said holder, said closure having openings aligned with the open mouths of individual bags held in said holder, said openings being of distinctly different configuration from one another to encourage the deposit of the same kind of waste material through the same opening and different kinds, through different, appropriate openings.

7. The receptacle of claim 5 wherein said closure has a downwardly extending rim of a size and shape to embrace closely said upper edges of said receptacle, and parts of said bags projecting outwardly from said openings are caged between said rim and said upper part of said receptacle.

8. The receptacle of claim 1 including a removable rack member mounted on at least two upper margins of said bag holder, said rack member having contiguous lobes defining between them openings opening through their uppermost portion, said openings being of a size to admit material at the upper part of said bags and to hold said material tightly between contiguous of said lobes, for holding a plurality of liner bags.

9. In a container having an upper lip defining an open mouth and a detachable and re-attachable cover, said cover comprising a frame with an outer flange shaped complementarily to the perimeter of said upper lip and dimensioned to embrace and frictionally to engage said upper lip, said frame defining an opening, and a lid, pivoted to said frame at both ends of a center line of said lid, within said opening, being normally biased to a mouth closing position and adapted to be swung away from said mouth closing position to permit entry of material to one side or the other side of said mouth, the improvement comprising slots extending through said lip and opening upwardly therethrough, said slots being substantially aligned with said lid center line and each being of a width and depth to accommodate a part of upper margins of two thin plastic bags, another part of which margins of the two bags extends between said slots substantially parallel to one another, and another part of each of which margins is draped over said lip and held between said lip and said frame flange, whereby when said lid is swung in mouth-opening direction, material passed through the opening on one side of said center line passes into one bag, and material passed through the opening on the other side passes into the other bag.

10. The container of claim 9 including indicia on said lid on both sides of the center line of said lid, indicating the type of waste to be placed in the bag on that side.

11. In a container housing a plurality of thin, flexible, open-topped bags, a strip of flexible material around and defining the upper edge of an upwardly opening mouth of said container, said strip being adapted to hold an upper edge of each of said plurality of bags in open condition, said strip comprising a multiplicity of flexible lobes positioned uniformly around said open mouth, said lobes being contiguous one another, immediately adjacent edges of said lobes defining between them a bag-material receiving slit, said immediately adjacent edges lying in substantially the same plane, and said lobes being resiliently bendable out of said plane with respect to adjacent lobes to facilitate release of said bag material from said slit.

* * * * *